United States Patent [19]

Lindberg

[11] Patent Number: 4,991,489

[45] Date of Patent: Feb. 12, 1991

[54] LOADING DEVICE

[75] Inventor: Sven Lindberg, Degerfors, Sweden

[73] Assignee: Aktiebolaget Bofors, Karlskoga, Sweden

[21] Appl. No.: 409,662

[22] Filed: Sep. 20, 1989

[30] Foreign Application Priority Data

Sep. 21, 1988 [SE] Sweden ..... 8803335

[51] Int. Cl.[5] ..... F41A 9/38

[52] U.S. Cl. ..... 89/6.5; 89/45; 89/47

[58] Field of Search ..... 89/6, 6.5, 45, 46, 47

[56] References Cited

U.S. PATENT DOCUMENTS

| | | | |
|---|---|---|---|
| 1,360,523 | 11/1920 | Hadcock et al. | 89/47 |
| 4,402,253 | 9/1983 | Gustavsson et al. | 89/46 |
| 4,457,209 | 7/1984 | Scheurich et al. | 89/45 |

FOREIGN PATENT DOCUMENTS

| | | | |
|---|---|---|---|
| 2413983 | 10/1979 | Fed. Rep. of Germany . | |
| 931240 | 2/1948 | France | 89/47 |
| 334974 | 1/1936 | Italy | 89/6 |
| 7400465 | 4/1977 | Sweden . | |
| 7405121 | 1/1981 | Sweden . | |
| 1410798 | 10/1975 | United Kingdom . | |

*Primary Examiner*—Stephen C. Bentley

*Attorney, Agent, or Firm*—Pollock, Vande Sande & Priddy

[57] ABSTRACT

A loading device for large-caliber weapons allows for firing with rounds consisting of different types of projectiles and charges/cartridges of different sizes which are combinable with the projectiles upon being loaded into the weapon. The projectiles are placed in a first magazine at which a first transfer device is disposed. This first transfer device transfers each respective projectile to the axis of the bore of the weapon so as to make possible the interaction of the projectile with a ramming device which rams home each respective projectile placed in the axis of the bore. The charges/cartridges are placed in a second magazine at which second transfer devices are disposed, for transferring each respective charge/cartridge to a defined position behind the associated projectile rammed home by the ramming device. The transfer and ramming devices are arranged, together with magazine control devices and sweeper devices for the cartridges, to cofunction in a fully automatic loading function for the projectiles and the charges/cartridges.

16 Claims, 5 Drawing Sheets

LOADING DEVICE

TECHNICAL FIELD

The present invention relates to a loading device in large-caliber weapons, the device being arranged to allow firing with rounds consisting of projectiles of different types, lengths, etc., and charges of different sizes, preferably in the form of cartridges, combinable with the projectiles in the weapon on loading.

BACKGROUND ART

In wheelborne large-caliber weapons, for example field howitzers, and in tracked large-caliber weapons, MBTs, it is previously known to carry out firing with split ammunition which consists of projectiles and their associated charges/cartridges. The prior-art loading devices may be regarded as mechanical aids for the loading function. Each respective projectile is applied by means of a loading platform and the like to a pivoting loading bridge which is swung in to the axis of the bore of the weapon. The cartridge or cartridges are similarly inserted in the axis of the bore of the weapon and the entire unit is rammed home using a rammer. The prior-art loading procedures have hitherto required the participation of members of the gun crew in different stages of the loading cycle.

The demands for greater ranges, firing with varied ammunition, shorter loading cycles etc. place steadily growing demands on the loading function of the type of weapon under consideration here.

At long ranges, for example of the order of 40 kilometers and longer, noise levels become very high (185 dB), with the result that the gun crew cannot be stationed in the vicinity of the weapon at the moment of firing without running the risk of serious injury.

Consequently, there is a need for fully automatic loading systems which ensure reliable and safe loading cycles. The requirement is then that salvos of a given number of rounds be fireable. After firing, rapid redeployment of the artillery weapon (or the MBT) must be possible, as well as efficient reloading.

The propellant charges for long ranges take up a considerable amount of space in and around the weapon and it is also a matter of some urgency that the fully automatic loading system does not encroach upon the elevation and traversing angle fields of the weapon, or impair the manoeuvreability of the weapon in the field etc.

The largest charges for weapons of the type contemplated here may be designed with large diameters, which gives rise to problems in the ramming and extraction or sweeping functions.

SUMMARY OF THE INVENTION

The object of the present invention is to propose a loading device which makes for a fully automated loading function in which the various problems outlined above may be obviated.

According to the novel features of the device according to the present invention the projectiles may be placed in a first magazine from which each respective projectile is transferred by means of first transferring devices to the axis of the bore of the weapon for interaction with a ramming device which is operative to ram home each respective projectile placed in the axis of the bore into the weapon. A further characterizing feature of the device according to the present invention is that the charges/cartridges are placed in a second magazine from which each respective charge/cartridge is transferrable by means of second transfer devices to a defined position behind its associated projectile rammed home by the rammer. Finally, the present invention is characterized in that the transfer and rammer devices are arranged to co-function, together with magazine control devices and extractor, or sweeper devices in a fully automatic loading function for projectiles and charges/cartridges.

In one embodiment of the present invention, each respective projectile is rammed home with the aid of a loading bridge and the rammer which may then be considered to have been allocated the projectile. Each respective charge/cartridge is placed without rammer directly in place with the aid of a retention function in the second transfer device, for example in the form of a cartridge canister.

In a further embodiment of the present invention, the first magazine may include a first revolver magazine placed at the first side of the weapon (rearwardly at the breech block), this revolver magazine being arranged with its longitudinal axis inclined in relation to a horizontal plane. By this means, each respective projectile can be discharged from the first magazine by the projectile's own weight. In this way, no individual feed mechanism for each respective projectile length in the magazine need to be provided. The first magazine may be disposed on the traversing system of the weapon, the first transfer device then being in the form of a loading pendulum and a loading bridge inwardly and outwardly pivotally disposed thereon, the loading bridge being fitted with releasable retention members for each respective projectile. The weapon can thus be fired with a projectile on the loading bridge.

The first transfer device/loading bridge is preferably arranged so as to perform an elliptical movement on inward pivoting of each respective projectile to the axis of the bore. The rammer is preferably mounted in the cradle of the weapon and is arranged such that it commences its ramming movement for the projectile placed on the loading bridge before the inward pivoting movement of the loading bridge is completed. The rammer then operates at a ramming speed which exceeds the inward pivoting speed of the loading bridge. In this manner, the rammer catches up the loading bridge for commencement of the ramming process before the loading bridge has fully completed its inward pivoting movement. By this means, the inward pivoting and ramming functions can dovetail together in an unbroken advancement movement for the projectile and an efficient and rapid ramming function will be obtained. The locking members of the loading bridge are releasable before the rammer enters into interaction with the projectile placed on the loading bridge. In one embodiment, the rammer is designed, during its interaction with each respective projectile, to hold the rear portion of the projectile in a raised position during the ramming operation proper, so as to avoid jamming. The rammer is further designed to be foldable up and down so as to allow for the passage of the breech block above the rammer on recoil.

The second magazine also preferably includes a second revolver magazine disposed on the elevating mass of the weapon on the other side of the weapon. The second transfer device is preferably designed with a cartridge canister secured to the elevating mass of the weapon. The second transfer device is provided with second retention members which fixedly clamp the charge/cartridge during the inward pivoting movement to the defined position behind its associated projectile. The second release device may be triggered when, or just before, the charge/cartridge assumes its position behind the projectile so as to make possible extraction, by the extractor, of the charge/cartridge from the second transfer device/cartridge canister.

The above-mentioned magazine control device includes, in one embodiment, means for displacing/rotating the magazine and devices for releasing the projectile and feeding out the charge/cartridge. The first magazine may be designed with adaptors in each respective space for the projectiles. These adaptors are longitudinally displaceable and include activator devices for the fuzes of the projectiles.

The arrangement described in the foregoing makes for a reliable fully automatic loading function with a relatively simple technical construction. Redesign of existing basic models of the weapon will be unnecessary, since the novel loading device makes no inroads into the elevation and traverse areas, even though the system enables firing to be carried out at long ranges. Hence, the novel loading device according to the present invention can be applied to existing weaponry or be integrated in the weapon on new manufacture. The charge employed may be allowed to fill out the whole of the barrel chamber without having any effect on the loading function. Risks of jamming can be avoided where such occur. The magazine can be placed on available spaces on the artillery gun, i.e. on those places which, on conventional weapons, would normally be occupied by gun loader and layer. Firing with a projectile already on the loading bridge can be carried out due to the locking function of the loading bridge on the projectile. The magazine may readily be adjusted for projectiles and cartridges of different lengths, types, sizes, etc. The magazine is designed for, say, nine projectiles/cartridges, this constituting a number which is considered as appropriate from the practical point of view.

BRIEF DESCRIPTION OF THE ACCOMPANYING DRAWINGS

The nature of the present invention and its aspects will be more readily understood from the following brief description of the accompanying Drawings and discussion relating thereto of one preferred embodiment thereof.

DESCRIPTION OF OPERATIVE EMBODIMENT

Figure 1:
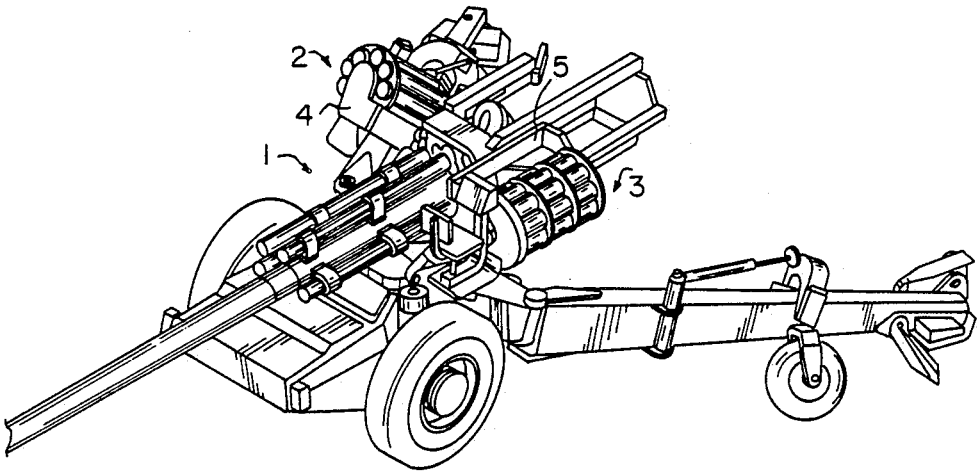
FIG. 1 is a perspective view obliquely from above of the loading device employed in a known wheelborne large-caliber weapon (FH 77)
Figure 2:
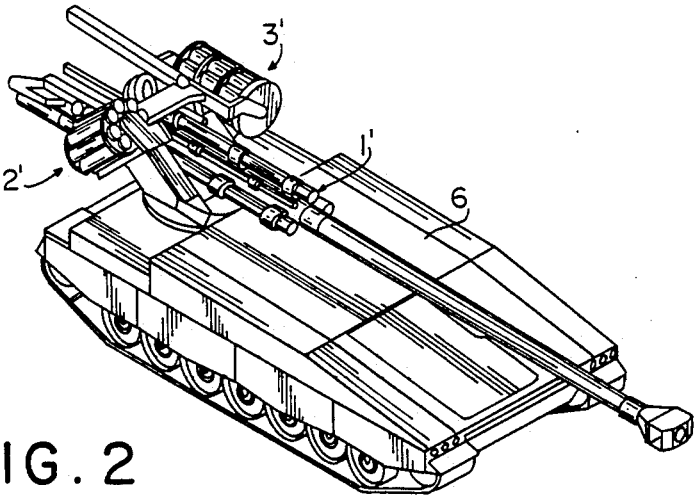
FIG. 2 is a perspective view obliquely from above of the loading device employed on a tracked large-caliber weapon, similarly of a known type.

Referring to the Drawings, FIGS. 1 and 2 show examples of large-caliber weapons, on which the loading device according to the present invention may be used. FIG. 1 shows a Bofors field howitzer FH 77, designated reference numeral 1, whose design and construction are known and will therefore not be described in greater detail here. In FIG. 1, the novel loading device according to the present invention is represented by two magazines 2 and 3, hereinafter designated first magazine 2 and second magazine 3. The first magazine 2 is disposed in a carrier 4 which is anchored in the traversing system of the weapon. The second magazine 3 is disposed in a carrier 5 which is anchored in the elevating mass of the weapon. The magazines are located at the rear regions of the weapon, the magazine 2 being disposed on the right-hand side and the magazine 3 on the left-hand side.

In FIG. 2, the loading device is shown mounted on a weapon 1' disposed on a tracked vehicle 6 of a known type. In this case, the magazines are designated 2' and 3' respectively.

Figure 3:
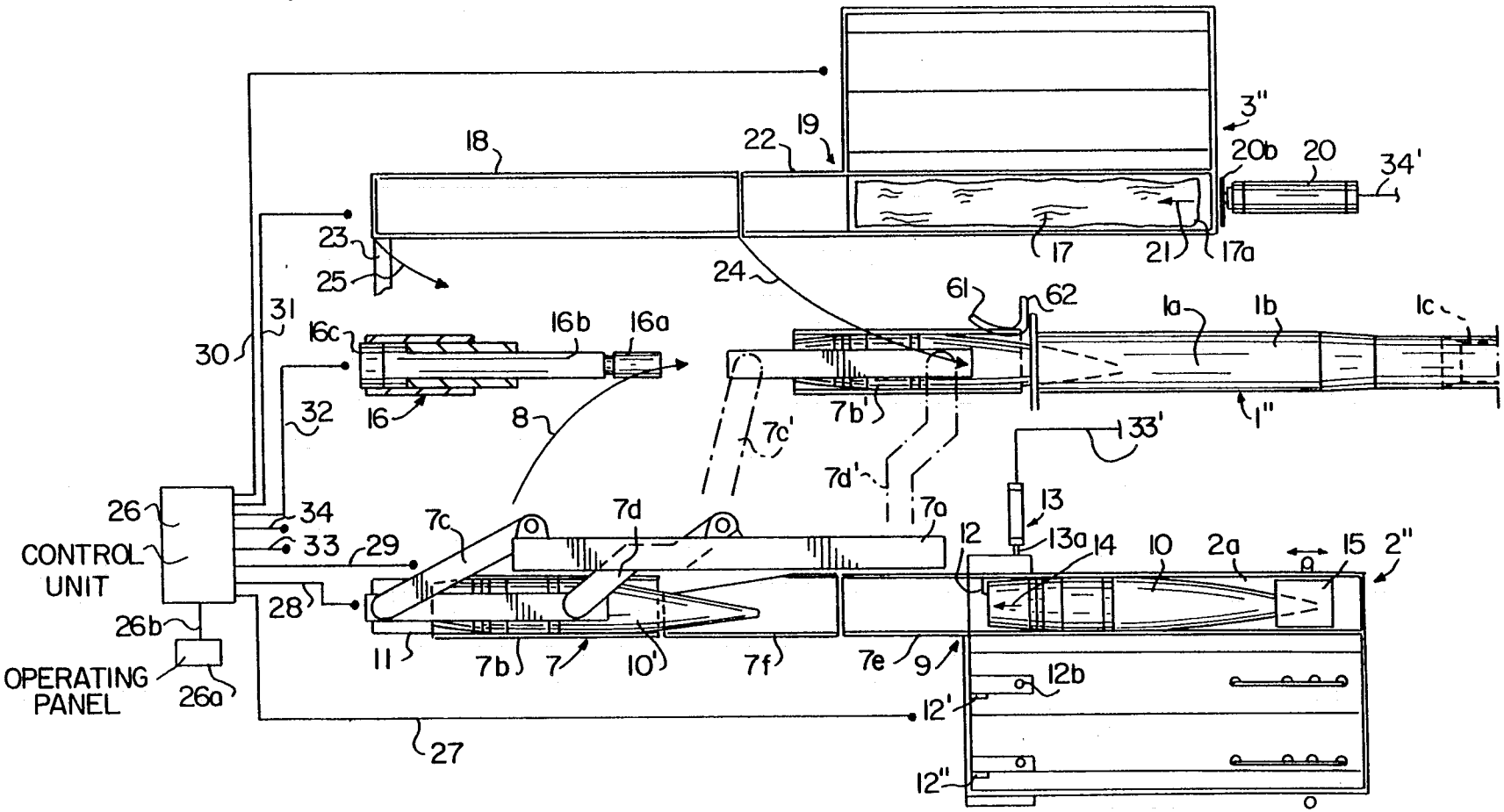
FIG. 3 is a horizontal view schematically illustrating parts included in the loading device.

According to FIG. 3, transfer devices are arranged at each respective magazine 2", 3". One transfer device 7 at the first magazine 2" includes a loading pendulum 7*a* and a loading bridge which is disposed thereon and is shown in a receiving position at the magazine 2" by reference numeral 7*b*, and in a position inwardly pivoted to the axis of the bore 1*a* of the weapon by reference numeral 7*b*'. The loading bridge may be journalled in a known manner in pivotal arms which, in a corresponding manner, are shown in two positions 7*c* and 7*d* and 7*c*' and 7*d*' respectively. The journalling of the loading bridge is of a special design in that the arms and their journallings in the bridge permit the bridge to be pivoted inwardly from position 7*b* to position 7*b*' following an elliptical path 8. As a result of this arrangement, the loading bridge executes, at the end of its inward pivoting movement, a longitudinal displacement movement substantially coinciding with the axis of the bore of the weapon.

The arrangement also includes loading channel portions 7*e* and 7*f* which, in the receiving position of the transfer device 7, are opposed to one another such that a projectile 10 located in the discharge position 9 of the magazine may pass via the starting position and the channel portions 7*e* and 7*f* down on to the loading bridge. A projectile fed down onto the loading bridge is indicated by reference numeral 10'. Rearwardly, the loading bridge is fitted with shock absorbers which are symbolically indicated by reference numeral 11. The magazine 2' is fitted with a releasable locking member 12 which may be of a known type, for example with hydraulic or magnetic control 13. A characteristic feature of the first magazine 2' is that its longitudinal axis, in accordance with the disclosures below, inclines in relation to a horizontal plane, so that on release of the locking member the projectile 10 slides down on to the loading bridge by its own weight. This considerably simplifies the construction of the first magazine which, for instance, need not be provided with various discharge devices for different projectile lengths. The outward sliding direction is indicated by the arrow 14 in FIG. 3. Each respective magazine space is provided with its locking member 12', 12'', and so on. The release member 13 may consist of a piston 13*a* which may be projected into a recess 12*b* in each respective locking member. When the piston 13*a* is moved in through the recess, the lock 12 is actuated (released) by the intermediary of a fulcrum arrangement of a known type.

Each respective magazine space 2*a* also includes an activation device 15 which is longitudinally displaceably disposed in the above-mentioned space. The activation device may be allocated a position where it interacts with the forward regions of each respective projectile which normally include fuzes or the like adjustable in response to the activation device 15.

The weapon includes a rammer 16 allocated to the projectiles and disposed in the cradle of the weapon. The rammer is provided with a rammer head 16*a* which is disposed at the end of a telescopic portion 16*b* which, in a known manner, is protractible by means of a piston 16*c*. The rammer is located behind the inward pivotal position 7*b'* of the loading bridge. The arrangement is such that the rammer is actuated/started before the loading bridge 7*b* has completed its inward pivotal movement along the elliptical path 8. When the loading bridge reaches the axis of the bore 1*a*, the rammer catches up the loading bridge enabling the rammer head 16*a* to enter into interaction with the rear plane of the projectile. The holding function of the loading bridge for the projectile is released before the rammer head 16*a* enters into interaction with the rear plane. The rammer operates at a higher speed than the loading bridge and, with the aid of inherent kinetic energy in the projectile, will readily further accelerate the projectile so that it is thrown forwardly into the chamber 1*b* and, by free flight, reaches its ramming position at the start of the barrel rifling 1*c*. After the ramming operation carried out in this manner, the rammer may be withdrawn and the loading bridge returned to its position 7*b* to receive a new projectile from the magazine which has been advanced (rotated) so that the magazine space with a projectile is placed in the discharge position 9, and so on.

The loading device also includes second transfer devices which transfer charges/cartridges 17 from the magazine to a defined position behind a thus rammed projectile. The second transfer device includes a cartridge canister 18 which may be registered with a discharge position 19 for the second magazine. In the discharge position, the cartridge 17 may be longitudinally displaced out into the canister with the aid of a displacement member 20 which is disposed at the forward end of the magazine. The displacement member may consist of a hydraulic cylinder, pneumatic cylinder, chain arrangement, etc. The displacement member includes a plate 20*b* which can interact with one end 17*a* of the cartridge. The direction of displacement is indicated by reference numeral 21. The second magazine is provided with a guide channel portion 22 through which the cartridge passes on its passage out into the cartridge canister. The cartridge canister is journalled in arms, of which only one, designated 23, is shown in the figure. The journalling and design of the arms 23 may be of a known type. The cartridge canister is of special design, such that it fixedly clamps a discharged cartridge and holds this fixedly clamped until such time as the cartridge has been pivoted into the defined position behind the rear face of the projectile. When the cartridge canister reaches its inwardly pivoted position, or immediately before this position, the clamping devices are released and the canister may be withdrawn to its starting position at the magazine. Before the return to the starting position, a doctor, or extractor mechanism, enters into interaction with the rear portion of the cartridge, causing the cartridge to remain in the space vacated by the canister. In FIG. 3, the inward pivoting movement is indicated by the arrows 24, 25.

The above-disclosed functions may be controlled from a central unit (e.g. the computer unit of the gun) 26. Alternatively, a number of these functions may be controlled by the movement functions of the gun and/or the loading device in a known manner. Such controls have been symbolically intimated in FIG. 3 by different connection leads. Via one lead (connection) 27, operation of the rotation of the first magazine 2'' will be obtained. The connections 28 and 29 symbolize the actuation of the pendulum and loading bridge movements. Correspondingly, the second magazine 3'' is controlled by a connection 30. The cartridge canister is controlled via the connection 31 and the rammer via the connection 32. The release device 13 is controlled via a connection 33, 33' and the displacement member 20 via a connection 34, 34'. The control unit 26 may then be arranged so that, for instance, the movements of the loading bridge 7*b* and the rammer 16 are coordinated so that uniform acceleratory movement is obtained for the projectile from the starting position 7*b* up to the ramming position at the start of the barrel rifling 1*c*. The loading pendulum is controlled so that it is set to collect a projectile in the magazine position (discharge position), whereafter it is guided into the current elevation position of the barrel. From this set elevation position, the loading bridge 7*b* is actuated in accordance with the above disclosures. The unit 26 may include or be connected to an operating panel 26*a* for operating the loading functions. In those cases when a gun crew may not be stationed in the vicinity of the gun while firing takes place, the unit may be disposed or arranged at a distance from the gun. A connection 26*b* between the panel 26*a* and the unit 26 consists of a wired or wireless connection. In the event that the gun is track-mounted (FIG. 2), this may be effected in a sound-insulated mode for high levels.

Figure 4:
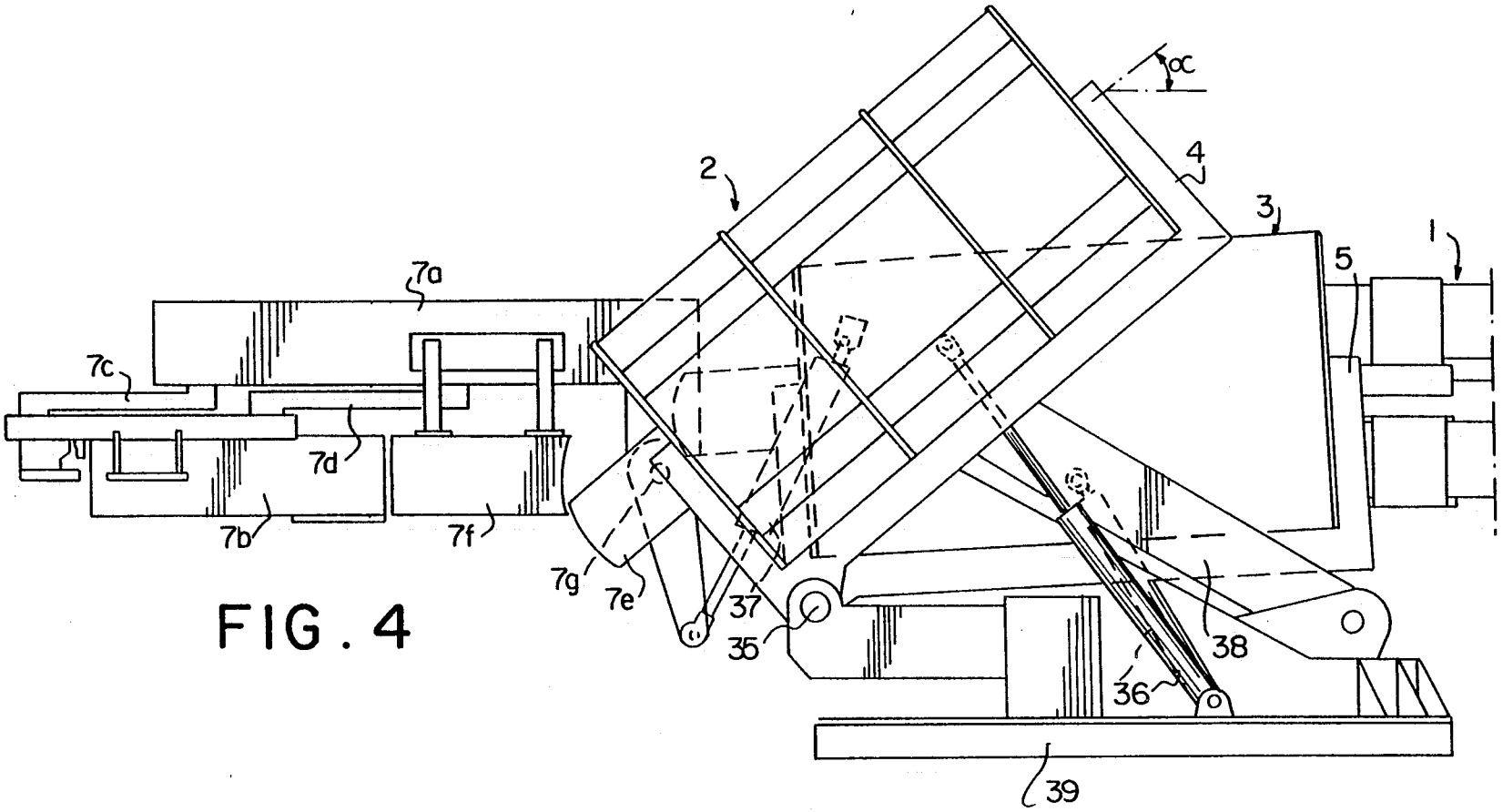
FIG. 4 is a side elevation of a first magazine for projectiles, with associated transfer devices including a loading pendulum and loading bridge journalled thereon.

FIG. 4 illustrates the journalling of the first magazine 2 and the pendulum 7*a*, as well as of the loading bridge 7*f*. The first magazine is tiltably carried in a journal 35 of the carriage 4. The tilting movements are achieved with the aid of a cylinder 36. In the firing position of the weapon 1 illustrated in FIG. 4, the magazine assumes a tilted position with the angle of tilt $\alpha$. In off-road manoeuvring, the magazine can be collapsed to a horizontal position which corresponds to the position illustrated in FIG. 1 for the magazine 3. The loading pendulum 7*a* is actuated by a cylinder 37. The cylinder is controlled in accordance with the above disclosures from the unit 26. The loading pendulum assumes a position which corresponds to the position of elevation of the weapon 1. In FIG. 4, the cylinder for elevating the weapon 1 is also indicated by means of reference numeral 38. The platform of the traversing system is indicated by reference numeral 39 and the pendulum journal by reference numeral 7g.

Figure 5:
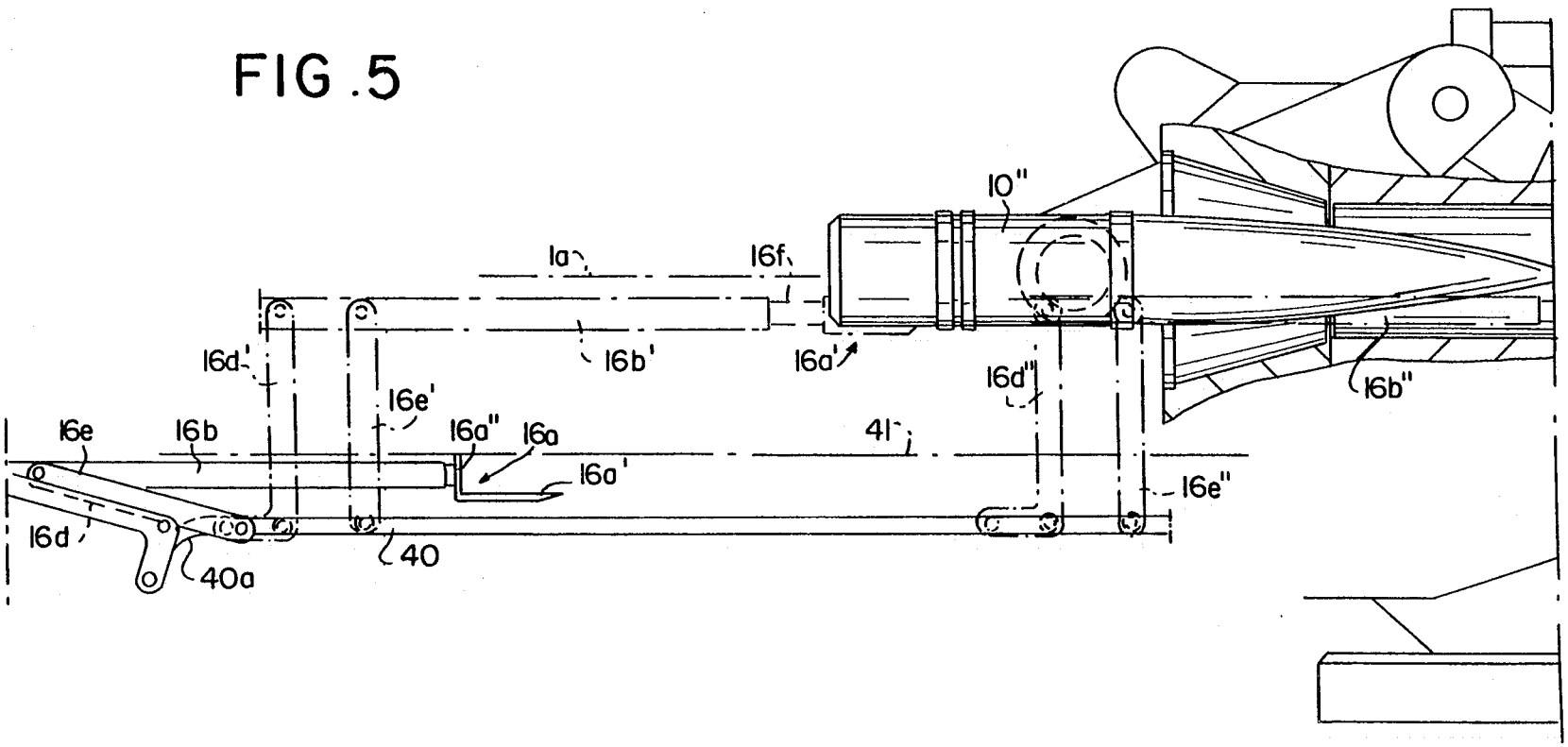
FIG. 5 is a schematic side elevation illustrating upwardly and downwardly foldable ramming devices for the projectiles, disposed in the cradle of the weapon.

FIG. 5 illustrates the elevation and depression function of the rammer 16 (see FIG. 3). The portion 16b is displaceable in parallel by means of two arms 16d and 16e which, at the bottom, guide in a cam 40 which, at its one end, displays a curved portion 40a. The one arm 16d is L-shaped at the bottom and, together with the arm 16e, is arranged so that when the portion 16b is displaced forwardly, for instance by a chain drive (not shown in detail), the arms are raised to the positions 16d' and 16e' respectively, whereupon parallel displacement (elevation) of the portion 16b takes place to the position 16b'. In this position, the portion 16b is parallel with the axis of the bore 1a. The rammer head assumes a position 16a', where it has entered into interaction with the rear face of the projectile 10''. The rammer head is designed with mutually angled portions 16a', 16a'', of which the one portion 16a' is capable of interaction with a side surface on the projectile so that this is kept raised by the rammer head. The portion 16a'' functions as a direct shunting surface for the rear plane of the projectile. The design of the head may be varied and it is conceivable that the rammer head could be capable of gripping the projectile at additional points. The most forward position of the rammer is indicated by the arm positions 16d'', 16e'', and the position 16b'' for the part 16b.

The part 16b' may be telescopic with two or more telescope sections. One such telescope section is illustrated by reference numeral 16f, and this telescope section is displaced in relation to the part 16b' by means of a piston device (see 16c in FIG. 5). The telescopic function is actuable at the same time as the travel movement of the rammer is executed. Alternatively, the travel movement is first executed, followed by the telescoping movement, or vice versa. The rammer is depressable below a defining line 41 of the recoil of the breech block. The design and control of the rammer may be realized in known manners and with known parts.

Figure 6:
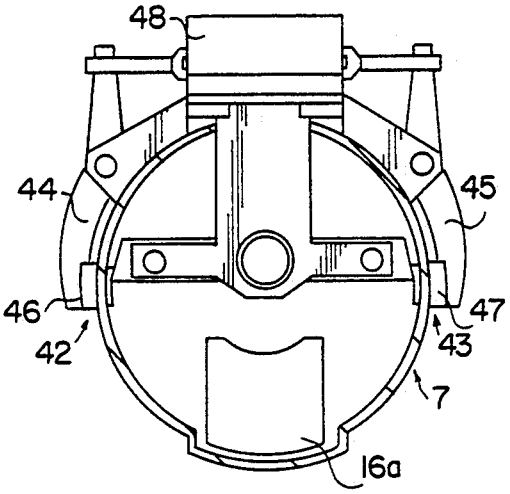
FIG. 6 is a vertical section showing the loading bridge with associated clamping members for a projectile fed down onto the loading bridge.

FIG. 6 shows retention means 42 and 43 for a projectile placed on the loading bridge. In the illustrated embodiment, the retention means include linkage arms 44, 45 which, at their ends, carry interacting members 46, 47 which, in response to linkage arm actuation, are capable of interaction with portions, for example the driving band, on the projectile. The arms are actuated by means of an activator 48 which receives control signals in response to the movements of the loading bridge, control signals from the control unit 26 (FIG. 3) or the like. The design and function of the retention means, as well as their control function, may be effected in a known manner and will not, therefore, be described in greater detail here. The retention means are intended to be activated when the projectile has been fed down onto the loading bridge and is to be released (triggered) when the rammer 16a enters into interaction with the rear plane of the projectile, or immediately prior thereto.

Figure 7:
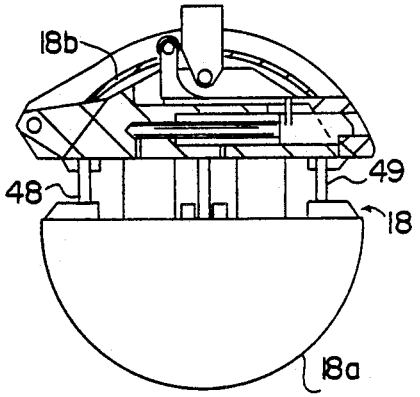
FIG. 7 is a vertical section through a cartridge canister which is provided for fixedly clamping the cartridges during the transfer movement from the cartridge magazine to a defined position behind its associated, rammed projectile.

FIG. 7 shows the cartridge canister 18 which, in the illustrated embodiment, consists of two separable halves/parts 18a and 18b which are dish-shaped. In the opened position, each respective cartridge is insertable into the cartridge canister and, in the closed position of the canister halves, these clamp about the cartridge/-cartridges so that a fixed retention function is created. The cartridge canister and cartridge may be arranged so that the cartridge canister permits a certain forward projection overhang for the cartridge which, in such cases, is rigid. This affords advantages in long and bulky charges and tight gun chamber spaces. The canister halves 18a and 18b are mutually guided by guide members 48, 49. The guiding function may be realized in a number of known manners and may be initiated by movements in the parts of the loading device, the parts of the weapon itself or be controlled from the abovementioned unit 26.

Figure 8:
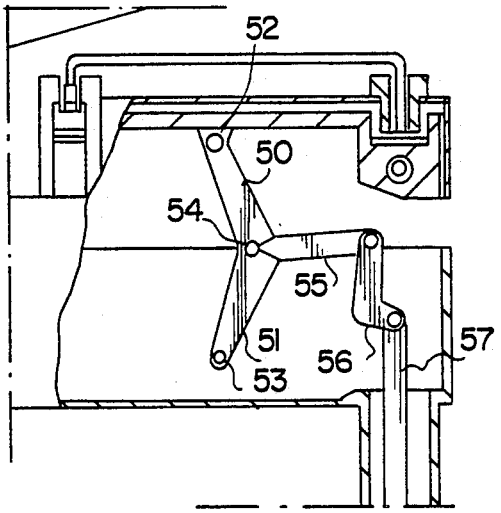
FIG. 8 shows actuation devices which realize fixed clamping of the cartridges during the inward pivoting of each respective cartridge into the axis of the bore of the weapon.

FIG. 8 illustrates an example of guiding by means of linkage arms. Two arms 50, 51 are pivotally journalled at points 52, 53. The arms 50 and 51 are jointly journalled at their other ends in a journal 54 and this journal is actuable by means of an activation arrangement 55, 56, 57 disposed such that the journalling point is displaceable in the longitudinal direction of the cartridge canister in response to activation movements. In FIG. 8, the journalling point 54 assumes a position in which the canister halves 18a, 18b have been drawn to the right in the Figure so that they clamp about an inserted cartridge or cartridges. On displacement to the left in FIG. 8, the journalling points 52 and 53 are urged in a direction away from one another, implying that the canister halves are separated, which makes it possible to sweep the cartridge from the cartridge canister. An arrangement as shown in FIG. 8 is provided in each respective canister end.

Figure 9:
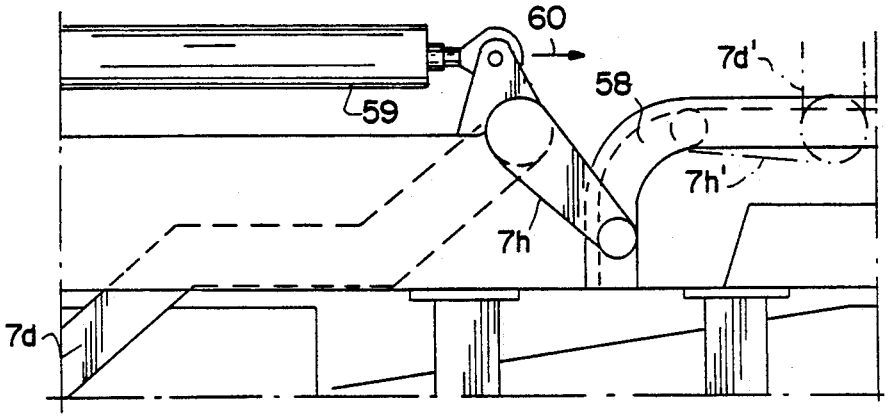
FIG. 9 is a side elevation schematically illustrating the control arrangement (cam) for the loading bridge.

FIG. 9 is intended to illustrate schematically how the elliptical movement 8 (see FIG. 3) for the charges is realized. The arm 7d is fitted with an angled portion 7h via which the arm guides into a cam 58. The actuation cylinder is indicated by reference numeral 59. On actuation of the piston of the cylinder in the direction of the arrow 60, the arrangement ensures that the arm may assume the position 7d' (cf. FIG. 3). The position of the part 7h has here been indicated by reference numeral 7h'. Corresponding cam guidance is provided for the second arm 7c of the bridge.

In FIG. 3, the sweeping function for each respective cartridge from the cartridge canister into the weapon proper has been schematically indicated by reference numeral 61. The sweeping function is controlled mechanically or electrically. For instance, the sweeper device 61 may be set in motion via 62 from one of the parts of the loading device or the weapon proper. Each respective magazine 2, 3 has a capacity of eight projectiles/cartridges. One projectile/cartridge may be placed on the loading bridge or in the canister, respectively. One projectile may further be rammed home, which together gives a total number of nine projectiles and a total number of eight cartridges prior to firing a salvo.

The present invention should not be considered as restricted to the embodiment described in the foregoing and shown on the accompanying Drawings by way of example, many modifications being conceivable without departing from the spirit and scope of the appended Claims and inventive concept as herein disclosed.

What we claim and desire to secure by Letters Patent is:

1. A loading device for use in large caliber weapons for firing with rounds consisting of projectiles of different types and charges/cartridges of different sizes combinable with the projectiles in the weapon on loading, comprising:

a first magazine for storing projectiles;

a first transfer device for transferring each respective projectile from said first magazine to the axis of the bore of the weapon;

a ramming device for interaction with said projectile for ramming home into the weapon said each respective projectile placed in the axis of the bore;

a second magazine for storing charges/cartridges;

a second transfer device for transferring each respective charge/cartridge to a defined position behind the associated projectile rammed home by said ramming device; and magazine control devices for controlling said transfer and ramming devices to provide a fully automatic loading function for the projectiles and charges/-cartridges; and wherein said first magazine includes a first revolver magazine placed on a first side of the weapon and having its longitudinal axis inclined in relation to a horizontal plane for allowing discharge of said each respective projectile from said first magazine with the aid of the projectile's own weight.

2. The device as claimed in claim 1, wherein said first magazine is disposed on the traversing system of the weapon; and wherein said first transfer device includes a loading pendulum and a loading bridge inwardly and outwardly pivotally disposed thereon and provided with releasable retention means for said each respective projectile.

3. The device as claimed in claim 1, wherein said first transfer device includes a loading bridge, which is adapted upon inward pivoting of said each respective projectile to the axis of the bore, for imparting to the projectile an elliptical path; and wherein said ramming device is disposed in a cradle of the weapon and is adapted to commence its ramming movement for the projectile placed on said loading bridge before the inward pivoting of the loading bridge to the axis of the bore has been completed; and wherein said ramming device operates at a ramming speed which exceeds the inward pivoting speed of said loading bridge, so that said ramming device catches up said loading bridge for commencement of the ramming cycle, which includes, in its final phase, free flight of the projectile.

4. The device as claimed in claim 2, wherein said releasable locking means of the loading bridge includes locking member which are releasable before said ramming device enters into interaction with said projectile placed on said loading bridge.

5. The device as claimed in claim 1, wherein said ramming device is adapted during its interaction with said each respective projectile, to hold the rear portion thereof raised so as to avoid jamming effects; and wherein said ramming device is upwardly and downwardly foldable to allow for the passage of the breech block on recoil.

6. The device as claimed in claim 1, wherein said second magazine includes a second revolver magazine disposed on the elevating mass of the weapon at a second side of the weapon.

7. The device as claimed in claim 1, wherein said second transfer device includes a cartridge canister disposed on the elevating mass of the weapon.

8. The device as claimed in claim 1, wherein said second transfer device is provided with second retention means for fixedly clamping said charge/cartridge during the inward pivoting movement to the defined position behind the associated projectile; and wherein said second release device is triggerable when, or immediately before, the charge/cartridge assumes its position behind the projectile so as to make possible the sweeping, by a sweeper device, of the charge/cartridge from the second transfer device.

9. The device as claimed in claim 1, wherein the fully automatic loading function of the projectiles and the charges/cartridges takes place in an interaction with a sweeper device for cartridge/charges; and wherein said magazine control devices include means for rotation/-displacement of the magazines, and projectile release and charge/cartridge displacement members; and wherein said first magazine for the projectiles includes longitudinally displaceable actuation members for the fuzes of said projectiles, the longitudinal displaceable capability making possible adaptation of said first magazine to different projectile lengths.

10. The device as claimed in claim 2, wherein said first transfer device includes a loading bridge which is adapted upon inward pivoting of said each respective projectile to the axis of the bore for imparting to said projectile an elliptical path; and wherein said ramming device is disposed in a cradle of the weapon and is adapted to commence its ramming movement for said projectile placed on the loading bridge, before the inward pivoting of said loading bridge to the axis of the bore has been completed; and wherein said ramming device operates at a ramming speed which exceeds the inward pivoting speed of said loading bridge so that said ramming device catches up said loading bridge for commencement of the ramming cycle, which includes, in its final phase, free flight of said projectile.

11. The device as claimed in claim 3, wherein said loading bridge is provided with locking members which are releasable before said ramming device enters into interaction with said projectile placed on the loading bridge.

12. The device as claimed in claim 4, wherein said ramming device is adapted, during its interaction with each respective projectile, to hold the rear portion thereof raised so as to avoid jamming effects; and wherein the ramming device is upwardly and downwardly foldable so as to allow for the passage of the breech block on recoil.

13. The device as claimed in claim 5, wherein said second magazine includes a second revolver magazine disposed on the elevating mass of the weapon, at a second side of the weapon.

14. The device as claimed in claim 6, wherein said second transfer device includes a cartridge canister disposed on the elevating mass of the weapon.

15. The device as claimed in claim 7, wherein said second transfer device is provided with second retention means fixedly clamping the charge/cartridge during the inward pivoting movement of the defined position behind the associated projectile; and wherein said second release device is triggerable when, or immediately before, the charge/cartridge assumes its position behind the projectile so as to make possible the sweeping, by a sweeper device, of the charge/cartridge from the second transfer device/cartridge canister.

16. The device as claimed in claim 8, wherein the fully automatic loading function for the projectiles and the charges/cartridges also takes place in interaction with a sweeper device for cartridge/charges; and wherein said magazine control devices include means for rotation/displacement of the magazines, and projectile release and charge/cartridge displacement members; and wherein said first magazine for the projectile includes longitudinally displaceable actuation members for the fuzes of said projectiles, the longitudinal displaceable capability making possible adaptation to different projectile lengths.

* * * * *